US009227399B2

(12) United States Patent
Kusakabe

(10) Patent No.: US 9,227,399 B2
(45) Date of Patent: Jan. 5, 2016

(54) CONTROL METHOD, PRINTING SHEET USED THEREFOR, AND PRINTING APPARATUS

(71) Applicant: CANON KABUSHIKI KAISHA, Tokyo (JP)

(72) Inventor: Taketoshi Kusakabe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 19 days.

(21) Appl. No.: 13/955,057

(22) Filed: Jul. 31, 2013

(65) Prior Publication Data

US 2014/0035982 A1 Feb. 6, 2014

(30) Foreign Application Priority Data

Jul. 31, 2012 (JP) ..... 2012-169226

(51) Int. Cl.
*B41J 2/07* (2006.01)
*B42D 15/00* (2006.01)
*B41J 2/165* (2006.01)

(52) U.S. Cl.
CPC ..... *B41J 2/07* (2013.01); *B41J 2/16526* (2013.01); *B42D 15/00* (2013.01)

(58) Field of Classification Search
CPC ..... B41J 2/07; B41J 2/16526; B42D 15/00
See application file for complete search history.

(56) References Cited

U.S. PATENT DOCUMENTS

| | | | | |
|---|---|---|---|---|
| 4,268,943 | A | 5/1981 | Watanabe et al. | |
| 4,317,270 | A | 3/1982 | Watanabe et al. | |
| 5,532,799 | A | 7/1996 | Watanabe et al. | |
| 5,915,146 | A | 6/1999 | Kusaka et al. | |
| 6,179,287 | B1 | 1/2001 | Watanabe et al. | |
| 6,240,263 | B1 | 5/2001 | Watanabe et al. | |
| 6,575,546 | B2 | 6/2003 | Matsumoto et al. | |
| 7,050,751 | B2 | 5/2006 | Watanabe et al. | |
| 2009/0279913 | A1* | 11/2009 | Hosoda | 399/69 |
| 2011/0141181 | A1* | 6/2011 | Ito et al. | 347/16 |
| 2011/0279508 | A1 | 11/2011 | Naito | |
| 2013/0088541 | A1* | 4/2013 | Naito | 347/16 |

FOREIGN PATENT DOCUMENTS

| | | |
|---|---|---|
| JP | H03-197140 | 8/1991 |
| JP | 2002-046260 | 2/2002 |
| JP | 2003-237157 | 8/2003 |
| JP | 4278885 | 6/2009 |
| JP | 2011-240492 | 12/2011 |
| JP | 2011-240493 | 12/2011 |

* cited by examiner

*Primary Examiner* — Alessandro Amari
*Assistant Examiner* — Jeremy Delozier
(74) *Attorney, Agent, or Firm* — Fitzpatrick, Cella, Harper & Scinto

(57) ABSTRACT

A control method using a print head for printing a plurality of images on a continuous sheet has the steps of obtaining information in regard to a position and a level of a unique portion unsuitable for image printing that exists on the continuous sheet and of causing a maintenance operation of the print head by using a region where the unique portion exists on the continuous sheet based upon obtained information.

10 Claims, 5 Drawing Sheets

CONTROL METHOD, PRINTING SHEET USED THEREFOR, AND PRINTING APPARATUS

BACKGROUND OF THE INVENTION

1. Field of the Invention

The present invention relates to a control method for performing printing on a continuous sheet.

2. Description of the Related Art

In a printing apparatus for printing an image on a sheet, a unique portion has a characteristic which is different from a characteristic of other regions in the sheet (including a connecting portion (splice portion) between sheets), and the image can not be printed on the unique portion with accuracy. Therefore it is known to avoid the printing of the image onto the unique portion.

A printing apparatus disclosed in the specification of Japanese Patent No. 4278885, in a case of detecting a unique portion, defines the unique portion and a constant region in front of and in back of the unique portion as a non-image printing area. In addition, a length of a blank space between the non-image printing area and a region where an image is printed before the non-image printing area is detected, and an image that will be printed on the blank space is selected according to a relation between the length and a size of the image that will be printed thereafter.

In the printing apparatus disclosed in the specification of Japanese Patent No. 4278885, in a case where images each having a size in which the printing can not be performed in the blank space continue, the blank space can not be used as similar to the unique portion. Therefore the sheet of portions that include the blank space and the unique portion will not be used and will be disposed of.

SUMMARY OF THE INVENTION

The present invention provides a control method, a printing sheet used for the control method, and a printing apparatus, which can effectively use a unique portion existing on a sheet to suppress a consumption amount of the sheet as a whole.

In the first aspect of the present invention, there is provided a control method for printing a plurality of images on a continuous sheet by using a print head, including the steps of:

obtaining information in regard to a position and a level of a unique portion unsuitable for image printing that exists on the continuous sheet; and causing a maintenance operation of the print head by using a region where the unique portion exists on the continuous sheet based upon obtained information.

In the second aspect of the present invention, there is provided a printing sheet as a continuous sheet wherein information in regard to a position and a level of a unique portion unsuitable for image printing that exists on the continuous sheet is printed, the information being used to perform maintenance of a print head.

In the third aspect of the present invention, there is provided a printing apparatus for printing a plurality of images on a continuous sheet by using a print head, including:

an obtaining unit configured to obtain information in regard to a position and a level of a unique portion unsuitable for image printing that exists on the continuous sheet; and a performing unit configured to perform maintenance of the print head by using a region where the unique portion exists on the continuous sheet based upon obtained information.

According to the present invention, even if the unique portion exists on the sheet, the region where the unique portion exists can be used to perform suitable maintenance of the print head corresponding to a state of the unique portion. Therefore the unique portion existing on the sheet can effectively be used to suppress a consumption amount of the sheet as a whole.

Further features of the present invention will become apparent from the following description of exemplary embodiments (with reference to the attached drawings).

DESCRIPTION OF THE EMBODIMENTS

Hereinafter, an embodiment in the present invention of a printing apparatus using an inkjet method will be explained with reference to the accompanying drawings. The printing apparatus in the present embodiment is a high-speed line printer that uses an elongated, continued printing-sheet (continuous sheet longer than a length of a print unit (called one page or a unit image) to be repeated in a conveying direction), and is adapted for both of one-side printing and both-side printing. For example, this printing apparatus is appropriate for a field of printing a great number of sheets in a printing laboratory or the like.

It should be noted that in the present specification, even if a plurality of small images, characters, and blank spaces are mixed within a region of one print unit (one page), all of these elements included within this region are together called a single unit image. That is, the unit image means a single print unit (one page) in a case of sequentially printing a plurality of pages on a continuous sheet.

It should be noted that there are some cases where the term "the unit image" is not used but a term "an image" is simply used as the address term. A length of the unit image differs corresponding to an image size to be printed. For example, in a photo of an L-size, a length of the unit image in the sheet conveying direction is 135 mm, and in a sheet of A4-size, the length thereof in the sheet conveying direction is 297 mm. The present invention can widely be applied to a printing apparatus in which ink is used and dried, such as a printer, a printer complex, a copier, a facsimile apparatus, manufacturing apparatuses for various devices and the like.

Figure 1:
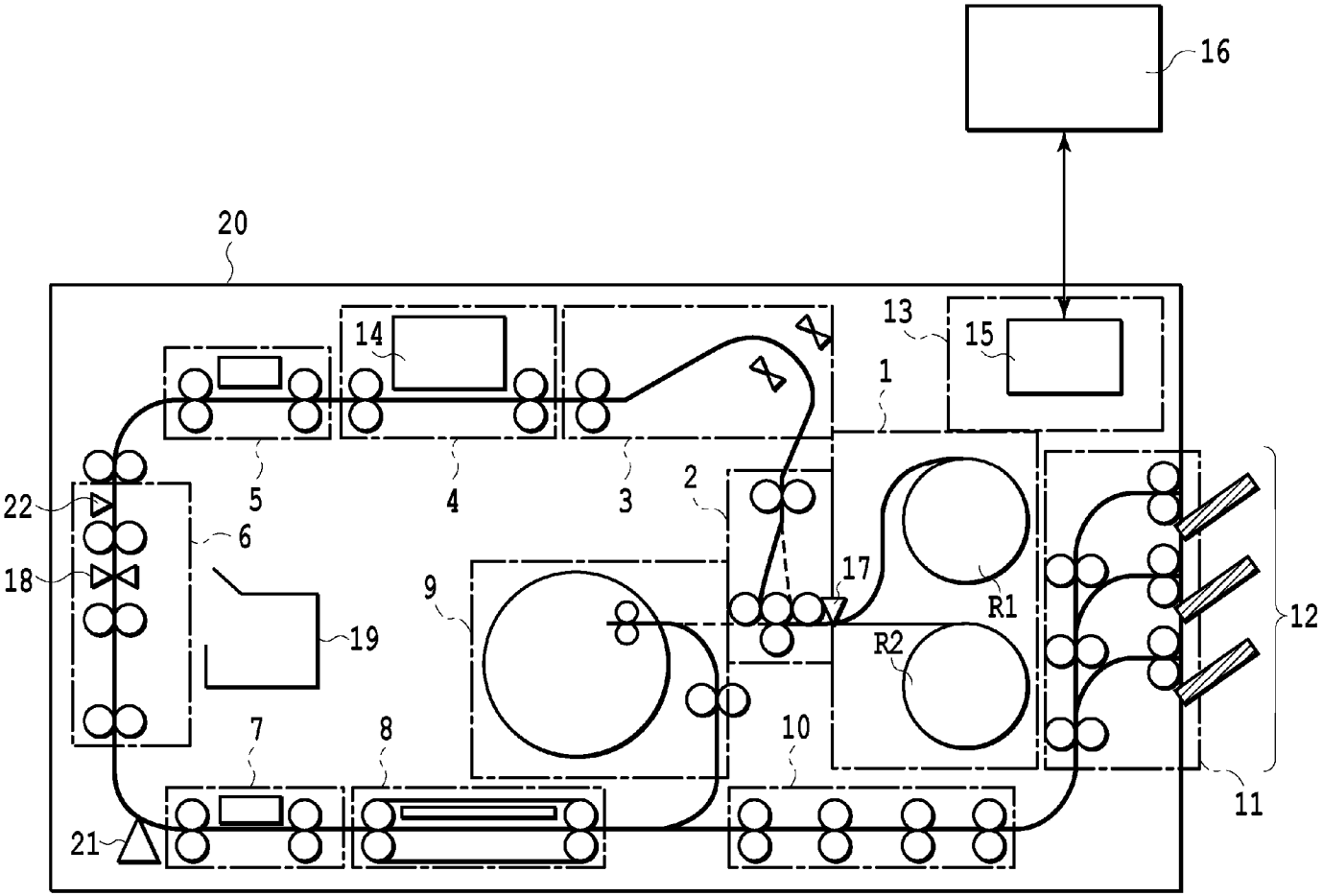
FIG. 1 is a schematic cross section showing the internal configuration of a printing apparatus according to an embodiment of the present invention.

FIG. 1 is a schematic diagram of a cross section showing the internal configuration of a printing apparatus 20 in the present embodiment. The printing apparatus 20 in the present embodiment uses a sheet which is wound a rolling shape, has a configuration capable of both-side printing on a first surface and a second surface which is the backside of the first surface. The printing apparatus 20 includes respective units of a sheet supply unit 1, a decurl unit 2, an oblique-pass correcting unit 3, a printing unit 4, an inspection unit 5, a cutter unit 6, an information printing unit 7, a drying unit 8, a reverse unit 9, a discharge conveying unit 10, a sorting unit 11, a discharge unit 12 and a control unit 13. The discharge unit 12 including the sorting unit 11 indicates a unit for performing discharge processing.

The sheet is conveyed along a sheet conveying path shown in a solid line in the figure by a conveying mechanism composed of paired rollers and a belt, and the processing is performed onto the sheet by each unit. It should be noted that in any position of the sheet conveying path, a side closer to the sheet supply unit 1 is called "upstream", and the reverse side is called "downstream".

The sheet supply unit 1 is a unit for holding and supplying the continuous sheet wound in the rolling shape. The sheet supply unit 1 is configured in such a manner as to be capable of accommodating two rolls R1 and R2 and selectively pull out the sheet for supply. It should be noted that the two rolls can be accommodated in the sheet supply unit 1, but the number of the rolls which can be accommodated therein is not limited to two, but one, three or more rolls may be accommodated therein.

In addition, as long as the sheet is a continued sheet, it is not limited to the sheet wound in a rolling shape. For example, the continued sheet may be configured such that the continued sheet having perforation for each unit length is folded back for each perforation to be stacked and accommodated in the sheet supply unit 1.

The continuous sheet to be used herein is designed to have a splice portion (connecting portion) jointed by a tape or paste at at least one location and at a random position. The splice portion differs in the thickness from the other region and is a region not suitable for printing an image. In the present embodiment, a region where a characteristic of the sheet differs partially from the other region that is unsuitable for image printing is defined as the unique portion. The unique portion includes the splice portion. In the present embodiment, the unique portion other than the splice portion means, for example, dirt, a hole, a damage, a fold, a break, foreign object mixing, a change in color, a portion uneven in thickness, or the like.

In the present embodiment, the unique portion is classified into three classes according to a level that the characteristic differs, and an application of the unique portion differs for each class.

The unique portion is not suitable for printing an image based upon image data. Therefore, in the present embodiment, the unique portion is read by a sensor 17 (detecting unit), and in a case where the unique portion can be used in the printing other than the printing of the image based upon the image data (for example, printing of a cut mark pattern or the like) according to a state of the unique portion, the unique portion is used. Therefore the sensor 17 is provided near the outlet port of the sheet supply unit 1 for the sheet. The sensor 17 detects the unique portion of the sheet supplied from the sheet supply unit 1.

It should be noted that in the present embodiment the sensor 17 is arranged near the outlet port of the sheet supply unit 1 for the sheet, but the arrangement of the sensor 17 is not limited thereto, and the sensor 17 is only required to be arranged between the sheet supply unit 1 and the printing unit 4.

The decurl unit 2 is a unit for reducing a curl of the sheet supplied from the sheet supply unit 1. In the decurl unit 2, two pinch rollers are used to one drive roller to curve and pass the sheet therebetween in such a manner as to provide a curl in the reverse direction to the sheet, thus applying a decurl force on the sheet to reduce the curl of the sheet.

The oblique-pass corrective unit 3 is a unit for correcting an oblique movement (inclination to an original direction of movement) of the sheet having passed the decurl unit 2. The oblique movement of the sheet is corrected by pressing a sheet end portion which will be a base side on a guide member. In the oblique pass corrective unit 3, a loop is formed in the sheet to be conveyed.

The printing unit 4 is a sheet processing unit for forming an image on the sheet conveyed using a print head 14 and performing printing processing to the sheet. That is, the printing unit 4 is the processing unit for performing predetermined processing on the sheet. The printing unit 4 is also provided with a plurality of conveying rollers for conveying the sheet. The print head 14 is a line type print head in which nozzle array of an inkjet type is formed in a range covering the maximum width of the sheet expected to be used. The print head 14 is configured such that a plurality of print heads is arranged in parallel along the conveying direction.

In the present embodiment, the printing apparatus includes seven print heads corresponding to seven colors of C (cyan), M (magenta), Y (yellow), LC (light cyan), LM (light magenta), G (gray), and K (black). It should be noted that the color number and the number of the print heads are not limited to seven. In regard to the inkjet type, a type using a heater element, a type using a piezo element, a type using an electrostatic element, a type using an MEMS element, and the like may be adopted. The inks of the respective colors are supplied respectively to the print heads 14 through respective ink tubes from respective ink tanks.

The inspection unit 5 is a unit for optically reading an inspection pattern or an image that is printed on the sheet in the printing unit 4 by a scanner to inspect a state of the nozzle in the print head, a sheet conveying state, an image position, and the like, thus determining whether or not the image is properly printed thereon. The scanner includes a CCD image sensor or a CMOS image sensor. In a case where in the inspection unit 5 it is determined that the image is not appropriately printed, the determination result is notified of an operation unit 15 or a host device 16 which will be described later, and the printing unit 4 is controlled to once more perform the printing as needed.

The cutter unit 6 is a unit provided with a mechanical cutter 18 for cutting a printed sheet to a predetermined length. The cutter unit 6 is further provided with a cut pattern sensor 22 for optically detecting a cut pattern that is printed on the sheet, and a plurality of conveying rollers for feeding out the sheet to the next process. A garbage box 19 is provided near the cutter unit 6. The garbage box 19 accommodates small sheet pieces that are generated by cutting the sheet in the cutter unit 6 and are discharged as garbage. The cutter unit 6 is provided with a sorting mechanism on whether the cut sheet is discharged to the garbage box 19 or is transferred to the original conveying path.

The information printing unit 7 is a unit for printing print information (specific information) such as a serial number and a date of the printing in the non-printing area of cut sheet. The printing is performed by printing characters and codes with an inkjet method, a thermal transfer method, or the like. A sensor 21 detecting a front end edge of the cut sheet is provided upstream of the information printing unit 7 and downstream of the cutter unit 6. The timing for printing the information in the information printing unit 7 is controlled based upon the detected timing of the sensor 21.

The drying unit 8 is a unit for heating the sheet that is printed in the printing unit 4 to dry the ink which is applied to the sheet in a short time. In inside the drying unit 8, an ink-applied face of the sheet is dried by providing a hot air to the sheet passing therein at least from the bottom side. It should be noted that the drying method is not limited to the method for providing the hot air, but may be a method for irradiating an electromagnetic wave (ultraviolet ray or infrared ray) with the sheet surface.

The sheet conveying path from the sheet supply unit 1 to the drying unit 8 as described above is called a first path. The first path is formed in a U-turn shape between the printing unit 4 and the drying unit 8, and the cutter unit 6 is positioned in midstream of the path of the U-turn shape.

The reverse unit 9 is a unit for temporarily reeling the continuous sheet on which the front-surface printing is completed at both-side printing to reverse the front-back relation. The reverse unit 9 is positioned in midstream of a path of a loop path (called a second path) from the drying unit 8 to the printing unit 4 via the decurl unit 2. The second path is a path for once more supplying the sheet having passed the drying unit 8 to the printing unit 4.

The reverse unit 9 is provided with a reeling drum rotating for reeling the sheet. The continuous sheet in which the printing on the front surface is completed and which is not cut is temporarily reeled by the reeling drum. When the reeling of the sheet is completed, the reeling drum rotates reversely to feed out the reeled sheet in the reverse order to the above reeling time, this sheet is supplied to the decurl unit 2 and is conveyed to the printing unit 4. This sheet is reversed in the front-back relation, and therefore printing can be performed on the back surface in the printing unit 4. When the sheet supply unit 1 is defined as a first sheet supply unit, the reverse unit 9 may be regarded as a second sheet supply unit. A more specific operation of the both-side printing will be described later.

The discharge conveying unit 10 is a unit for conveying the sheet which is cut in the cutter unit 6 and is dried in the drying unit 8, and delivering the sheet to the sorter unit 11. The discharge conveying unit 10 is provided in a path (called a third path) different from the second path in which the reverse unit 9 is arranged. For selectively guiding the sheet conveyed from the first path to either one of the second path or the third path, a path-switching mechanism having a movable flapper is provided in a branch position of the path (called "discharge branch position").

The discharge unit 12 including the sorting unit 11 is provided in the side portion of the sheet supply unit 1 and at the terminal of the third path. The sorter unit 11 is a unit for sorting the printed sheets for each group of the sheets as needed. The sorted sheets are discharged to a plurality of trays provided in the discharge unit 12. In this way, the third path has the layout of passing under the sheet supply unit 1 and discharging the sheet to an opposite side to the printing unit 4 or the drying unit 8 to sandwich the sheet supply unit 1.

As described above, the sheet supply unit 1 to the drying unit 8 are provided in order in the first path. The forward side of the drying unit 8 is branched into the second path or the third path. The reverse unit 9 is provided midstream of the second path. The forward side of the reverse unit 9 merges with the first path. The discharge unit 12 is provided in the terminal of the third path.

The control unit 13 is a unit for managing control of each unit in the entire printing apparatus 20. The control unit 13 includes a controller, an external interface, and an operation unit 15 with which a user performs input/output. The controller is provided with a CPU, a memory and various control units. An operation of the printing apparatus 20 is controlled based upon a command from the controller or from the host device 16 such as a host computer connected through the external interface to the controller.

The control unit 13 in the present embodiment determines a unique region mark that is read by the sensor 17, and limits the printing of an image based upon the determination result. That is, the control unit 13 controls the printing unit 4 according to the level that the unique portion is different in the characteristic such that ink other than ink for printing an image based upon image data, that is, ink that does not contribute to the printing of the image for maintenance of the print head can be applied to the unique portion.

Further, the control unit 13 varies an applying pattern for the maintenance of the print head to the unique portion, according to the level of the unique portion. The pattern for the print head maintenance has two kinds of preliminary ejection and non-ejection detection (monitoring). In the present embodiment, the kind of the maintenance to be executed is varied according to the level (state) of the unique portion. The details will be described later.

Figure 2:
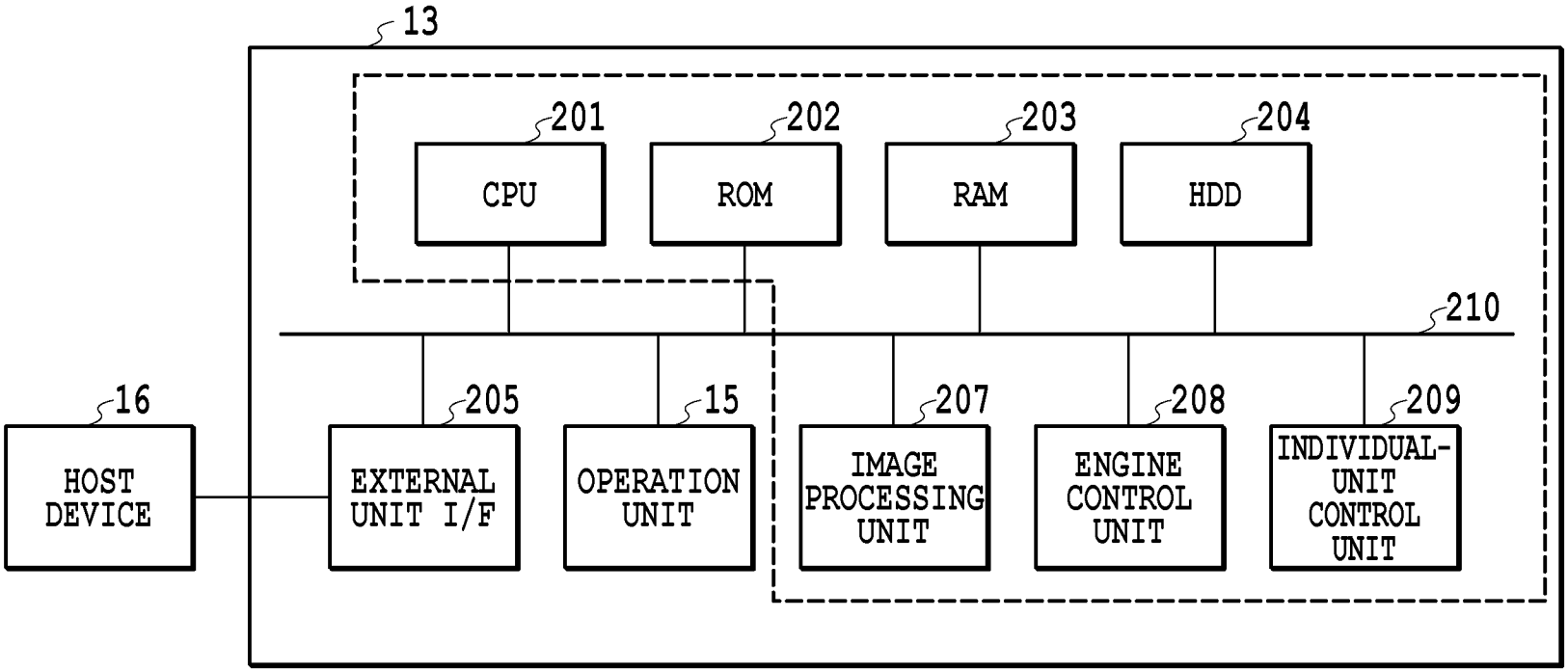
FIG. 2 is a block diagram showing the control configuration of the printing apparatus.

FIG. 2 is a block diagram showing the configuration of the control unit 13. The controller included in the control unit 13 (range enclosed by broken line shown in FIG. 2) includes a CPU 201, a ROM 202, a RAM 203, an HDD 204, an image processing unit 207, an engine control unit 208, and an individual-unit control unit 209.

The CPU 201 (central processor unit) integrally controls operations of the respective units in the printing apparatus 20. The ROM 202 stores therein programs for execution of the CPU 201 and fixed data required for various operations of the printing apparatus 20. The RAM 203 is used as a work area of the CPU 201, is used as a temporal storage area of various reception data, or stores various setting data therein. The HDD 204 (hard disc) can store therein or read out therefrom programs for execution of the CPU 201, print data, and setting information required for various operations of the printing apparatus 20.

The operation unit 15 is an input/output interface with a user, and includes input components of hard keys, a touch panel and the like, and output components of a display showing information, an audio generator and the like.

The unit that is required to execute high-speed data processing is provided with a dedicated processing unit. The image processing unit 207 executes image processing of print data that is dealt in the printing apparatus 20. A color space (for example, YCbCr) of the input image data is converted into a standard RGB color space (for example, sRGB). In addition, various kinds of the image processing such as resolution conversion, image analysis, image correction, or the like are executed to the image data as needed. The print data obtained by the above-mentioned kinds of the image processing is stored in the RAM 203 or the HDD 204.

The engine control unit 208 performs drive control of the print head 14 in the print unit 4 in accordance with print data based upon a control command received from the CPU 201 or the like. The engine control unit 208 further performs control of a conveying mechanism of each unit in the printing apparatus 20.

The individual-unit control unit 209 is a sub controller for individually controlling the respective units of the sheet supply unit 1, the decurl unit 2, the oblique-pass corrective unit 3, the inspection unit 5, the cutter unit 6, the information printing unit 7, the drying unit 8, the reverse unit 9, the discharge conveying unit 10, the sorting unit 11, and the discharge unit 12. The operations of the respective units are controlled by the individual-unit control unit 209 based upon commands from the CPU 201. The external interface 205 is an interface (I/F) for connecting the controller to the host device 16, and is a local I/F or a network I/F. The components as described above are connected through a system bus 210.

The host device 16 is a device as a supply source of image data for causing the printing apparatus 20 to perform printing. The host device 16 may be a general-purpose or dedicated computer, or an dedicated image instrument such as an image capture, a digital camera, a photo storage, or the like, which has an image reading unit.

In a case where the host device 16 is configured of a computer, an operational system, application software for generating image data, and a printer driver for the printing apparatus are installed in the memory accommodated in the computer. It should be noted that it is not necessarily required to realize all of the above-mentioned kinds of the processing by software, and a part or all thereof may be realized by hardware.

Next, a basic operation of the printing apparatus at printing will be explained. Since the printing operation differs between one-side printing and both-side printing, the respective printing operations will be explained.

In the one-side printing mode, the printing is performed on a front surface (first surface) of the sheet that is supplied from the sheet supply unit 1 and is processed in each of the decurl unit 2 and the oblique pass corrective unit 3 at the printing unit 4. Images each having a predetermined unit length (unit image) in the conveying direction are sequentially printed on the elongated continuous sheet, and a plurality of the images are lined up and formed thereon in order. The printed sheet passes through the inspection unit 5 and is cut by every unit image in the cutter unit 6.

In the cut sheet, the print information is printed on the backside of the sheet in the information printing unit 7 as needed. The cut sheets are conveyed one by one to the drying unit 8 for drying. Afterwards the cut sheets are sequentially discharged to and loaded on the discharge unit 12 in the sorter unit 11 via the discharge conveying unit 10. On the other hand, a sheet that is left in a side of the printing unit 4 by the cutting of the final unit image is fed back to the sheet supply unit 1 to be reeled by roll R1 or roll R2. In this way, in the one-side printing, the sheet passes through the first path and the third path and is processed, and does not pass through the second path.

On the other hand, at the both-side printing mode, the backside (second surface) printing sequence is performed following the front-side (first surface) printing sequence. In the first front-side printing sequence, the operations of the respective units from the sheet supply unit 1 to the inspection unit 5 are the same as the operations at the one-side printing as described above. The cut operation is not performed on the continuous sheet in the cutter unit 6, and the continuous sheet is conveyed to the drying unit 8 as it is. After drying the ink on the front side of the sheet in the drying unit 8, the sheet is not guided in the path (third path) in a side of the discharge conveying unit 10 but is guided in the path (second path) in a side of the reverse unit 9.

In the second path, the sheet is reeled on the reeling drum of the reverse unit 9 rotating in the forward direction (in a counter-clockwise direction in the figure). When the printing onto the front side of the continuous sheet to be expected is all completed in the printing unit 4, a rear end of the continuous sheet in the print region is cut in the cutter unit 6. The continuous sheet downstream of the cut position in the conveying direction (printed side) is all reeled to the sheet rear end (cut position) in the reverse unit 9 via the drying unit 8.

On the other hand, at the same time with the reeling of the continuous sheet in the reverse unit 9, the continuous sheet that is left upstream of the cut position in the conveying direction (in a side of the printing unit 4) is fed back to the sheet supply unit 1 such that the sheet front end (cut position) does not remain in the decurl unit 2, and the sheet is reeled in roll R1 or roll R2. The feeding-back (feedback) operation avoids collision of the continuous sheet with the sheet that will be again supplied in the following backside printing sequence.

The printing operation is switched to the backside printing sequence following the above front-side printing sequence. The reeling drum of the reverse unit 9 rotates in a reverse direction (clockwise direction in the figure) to a direction at the reeling time. An end portion of the reeled sheet (the sheet rear end at the reeling is a sheet front portion at feeding-out) is fed into the decurl unit 2 along the path in a broken line of the figure.

In the decurl unit 2, correction of the curl provided by the reeling drum is performed. That is, the decurl unit 2 is provided between the sheet supply unit 1 and the printing unit 4 in the first path, and between the reverse unit 9 and the printing unit 4 in the second path, which is a common unit serving as the decurl force in any path. The sheet reversed in the front-back side relation of the sheet is fed to the printing unit 4 via the oblique pass corrective unit 3, wherein printing is performed on the backside of the sheet.

The printed sheet passes through the inspection unit 5, and is cut in the cutter unit 6 for each predetermined unit length preset. Since the printing is performed on both the sides of a cut sheet, printing onto the cut sheet is not performed in the information printing unit 7. The cut sheets are conveyed one by one to the drying unit 8, passes through the discharge conveying unit 10, and are sequentially discharged to and loaded on the discharge unit 12 in the sorter unit 11. In this way, at the both-side printing, the sheet passes through the first path, the second path, the first path, and the third path, and be processed.

A printed matter that is completed by the printing of the printing apparatus 20 in the present embodiment can be classified into two matters. That is, the printed matter can be classified into two matters of an image printed matter that is printed by print data based upon the image data supplied from the host device 16 and an auxiliary printed matter necessary for maintaining a print quality of the image or the like. Further, the auxiliary printed matter can be classified into two matters of a reading printed matter that is read the print result and a disposal printed matter that is not read the print result.

Examples of the image printed matter include photos, postcards, posters, each page in a photo album, and the like. Examples of the reading printed matter include a sheet on which a detection pattern for monitoring an ejection state (including a non-ejection state) of ink in an ejection opening which is read by the scanner of the inspection unit 5 is printed, or a sheet on which a cut pattern that is read by the cut pattern sensor 22 of the cutter unit 6 is printed, and the like. Examples of the disposal printed matter include a sheet on which a preliminary ejection pattern used for maintenance of the print head is printed, and the like.

In the present embodiment, in a case where the auxiliary printed matter can be printed in a region having the unique portion, it is printed thereon.

Next, the unique portion will be explained. FIGS. 3A to 3G are diagrams for explaining kinds of the unique portions in a sheet 30 in the present embodiment, wherein FIGS. 3A to 3D are whole diagrams of the sheet 30, and FIGS. 3E to 3G are enlarged diagrams in which the unique portion and the unique portion mark are enlarged. As shown in FIGS. 3B to 3G, the unique portion in the present embodiment is classified into three classes (levels) of a light unique portion (second state), a middle unique portion (first state), and a heavy unique portion (third state) corresponding to the level that the unique portion differs in the characteristic from the other region.

In respect to the level which characteristic of the sheet is different from the other region of the sheet, the level of the light unique portion is lower than the level of the middle unique portion. That is, the level that the light unique portion gives an influence on the printing is lower as compared to a case of the middle unique portion. In respect to the level which characteristic thereof is different in the sheet, the level of the heavy unique portion is higher than the level of the middle unique portion. That is, the level that the heavy unique portion gives an influence on the printing is larger as compared to a case of the middle unique portion. A specific classification of the unique portion will be described later.

As shown in FIGS. 3A to 3D, the sheet 30 in the present embodiment has at least one region of four regions composed of three regions of the three levels of the unique portions and a region having no unique portion. In the present embodiment, for the convenience of description, the sheet having no unique portion and the sheets each having one of the three different unique portions are shown separately.

In addition, as shown in FIG. 3B to 3G, each of unique portion marks 31, 33 and 35 which information showing a position of the unique portion and the level of the characteristic of the unique portion is coded, is printed on one side of the sheet 30. In the present embodiment, an explanation will be made of an example in which the unique portion mark is printed in a region adjacent to the unique portion in the sheet such that the level that the characteristic of the unique portion differs is distinguishable. However, a printing method of the information in regard to the unique portion (position of the unique portion and the level which the characteristic of the unique portion differs) is not limited thereto. For example, the information in regard to the unique portion may be printed collectively in the front head portion of the sheet.

In addition, the information may be printed collectively in a package in which the sheet is wrapped, without printing in the continuous sheet itself, and a user inputs that information to the host device. Further, the information about the sheet may be stored collectively in a print medium such as a memory card which is attached to the sheet, and a user inputs that information to the host device. In this case, the information can be obtained by reading out the information that is input in the host device.

As shown in 3B to 3G, in the present embodiment, the unique portion mark is printed downstream of the unique portion in the conveying direction as the unique portion mark passes the sensor 17 before the unique portion. The unique portion mark is configured of two lines in parallel to each other along a direction perpendicular to the conveying direction. The detailed configuration of the unique portion mark differs for each of the three levels of the unique portions, and will be described later.

In addition, a constant region including the unique portion and the unique portion mark, that is, a constant range before and after the unique portion mark is a region not appropriate for printing print data based upon image data. In the present embodiment, among this region, a region that can not be used also for the printing of the auxiliary printed matter is called "non-printing area". In the present embodiment, a length of the non-printing area 37 in the conveying direction is set to 15 cm in each area before and after the unique portion mark. For detecting all of the unique portions in the sheet 30, the unique portion mark is preferably detected by the sensor 17 for each region that is smaller in size than the non-printing area 37.

Figures 3A, 3B, 3C, 3D:
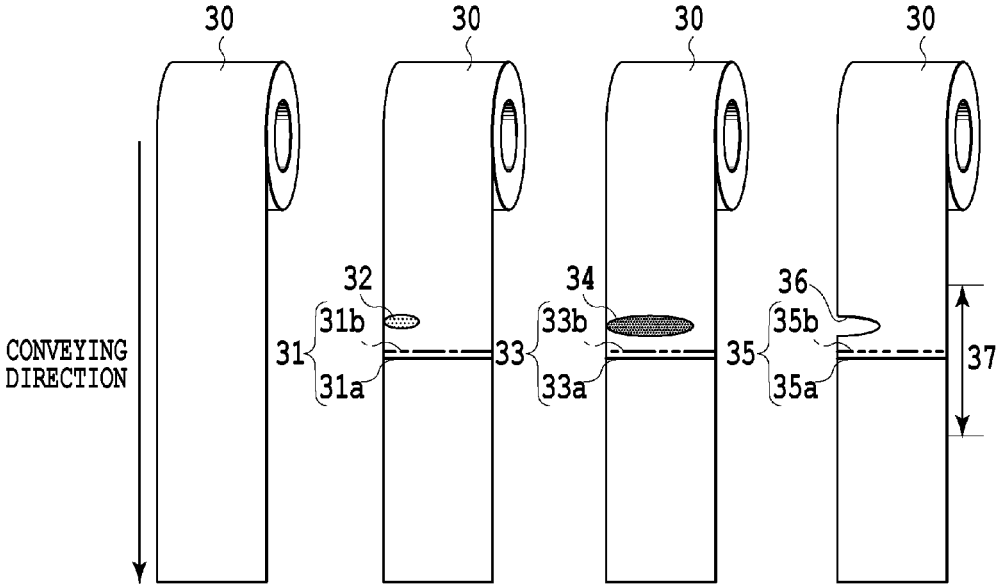
FIG. 3A is a diagram showing a region which has no unique portion on a sheet.
FIG. 3B is a diagram showing a region which has a light unique portion on the sheet.
FIG. 3C is a diagram showing a region which has a middle unique portion on the sheet.
FIG. 3D is a diagram showing a region which has a heavy unique portion on the sheet.
Figures 3E, 3F, 3G:
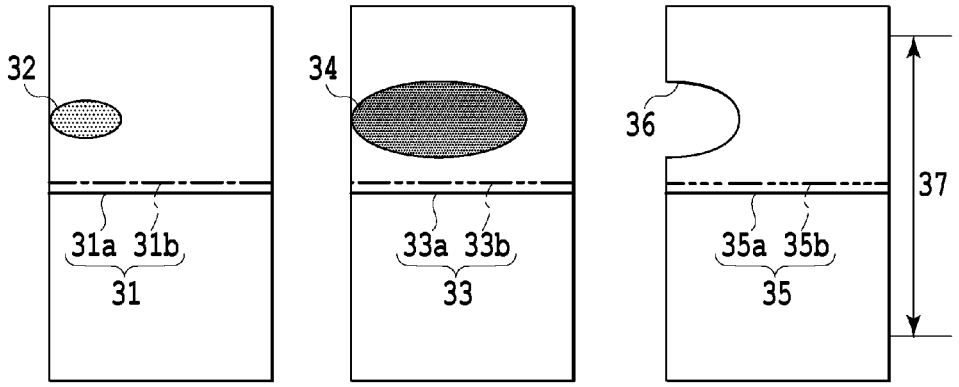
FIG. 3E is an enlarged diagram in FIG. 3B.
FIG. 3F is an enlarged diagram in FIG. 3C.
FIG. 3G is an enlarged diagram in FIG. 3D.

FIG. 3A shows a region having no unique portion in the sheet 30. Since the unique portion does not exist in the region of the sheet 30, the unique portion mark is not printed. FIGS. 3B to 3D respectively show regions in each of which the unique portion exists in the sheet 30. Therefore the unique portion mark is printed in each of the sheets 30 shown in FIGS. 3B to 3D and of the sheets 30 shown in FIG. 3E to 3G as enlarged diagrams of FIGS. 3B to 3D.

FIG. 3B shows a region where a light unique portion 32 exists in the sheet 30. In addition, FIG. 3E is an enlarged diagram of the sheet 30 shown in FIG. 3B. In the present embodiment, the light unique portion 32 is a unique portion that is relatively light in the density. In the present embodiment, at the time of reading the unique portion, light dirt in the RGB color space (200:200:200) is defined as the light unique portion 32. This light unique portion 32 can be used for printing a reading printed matter since the density is relatively light.

In FIG. 3B and FIG. 3E, a light unique portion mark 31 which shows that the light unique portion 32 exists in the sheet 30 is printed on the sheet 30. The light unique portion mark 31 is formed of a solid line 31*a* positioned in the downstream side in the conveying direction, and a dashed-dotted line 31*b* positioned in the upstream side in the conveying direction.

FIG. 3C shows a region where a middle unique portion 34 exists in the sheet 30. In addition, FIG. 3F is an enlarged diagram of the sheet 30 shown in FIG. 3C. In the present embodiment, the middle unique portion 34 is a unique portion that is deeper in the density than the light unique portion 32. Since the middle unique portion 34 is deep in the density, there is a fear that even if a pattern to be read by the sensor is printed on the middle unique portion 34, the pattern can not be read properly. However, since the middle unique portion 34 can absorb ink, it can be used for printing a disposal printed matter having no purpose of being read by the sensor.

In FIG. 3C and FIG. 3F, a middle unique portion mark 33 which shows that the middle unique portion 34 exists in the sheet 30 is printed on the sheet 30. The middle unique portion mark 33 is formed of a solid line 33*a* positioned in the downstream side in the conveying direction, and a dashed-two dotted line 33*b* positioned in the upstream side in the conveying direction.

FIG. 3D shows a region where a heavy unique portion 36 exists in the sheet 30. In addition, FIG. 3G is an enlarged diagram of the sheet 30 shown in FIG. 3D. In the present embodiment, the heavy unique portion 36 is a unique portion that can not absorb ink properly. Therefore it is preferable that any printing is absolutely avoided in the heavy unique portion 36. Examples of the heavy unique portion 36 include a hole, a break, and a splice portion.

It should be noted that in the present embodiment, an explanation will be made of an example of using sheets in which the sheets are jointed with each other by a tape and the tape is exposed in the jointed portion (splice portion). Accordingly, since the tape is exposed in the splice portion, the splice portion can not absorb ink properly. Therefore in the present embodiment, the splice portion is classified as the heavy unique portion.

However, the jointing method of the sheets of each other includes various methods such as a method of applying paste between sheets for the jointing or a method of jointing sheets with applying a tape between the sheets or the like. Therefore in some cases the splice portion is classified as the other unique portion (light unique portion or middle unique portion) depending on the jointing method of the sheets of each other. In this case, the splice portion may be used as needed.

In FIG. 3D and FIG. 3G, a heavy unique portion mark 35 which shows that the heavy unique portion 36 exists in the sheet 30 is printed on the sheet 30. The heavy unique portion mark 35 is formed of a solid line 35*a* positioned in the downstream side in the conveying direction, and a dashed-three dotted line 35*b* positioned in the upstream side in the conveying direction.

The configuration of each unique portion mark is not limited to the above-mentioned configuration, and is only required to show the position of the unique portion and to be able to distinguish the level that the characteristic of the unique portion differs. The unique portion mark may be, for example, a barcode or a two-dimensional code.

Figure 4:
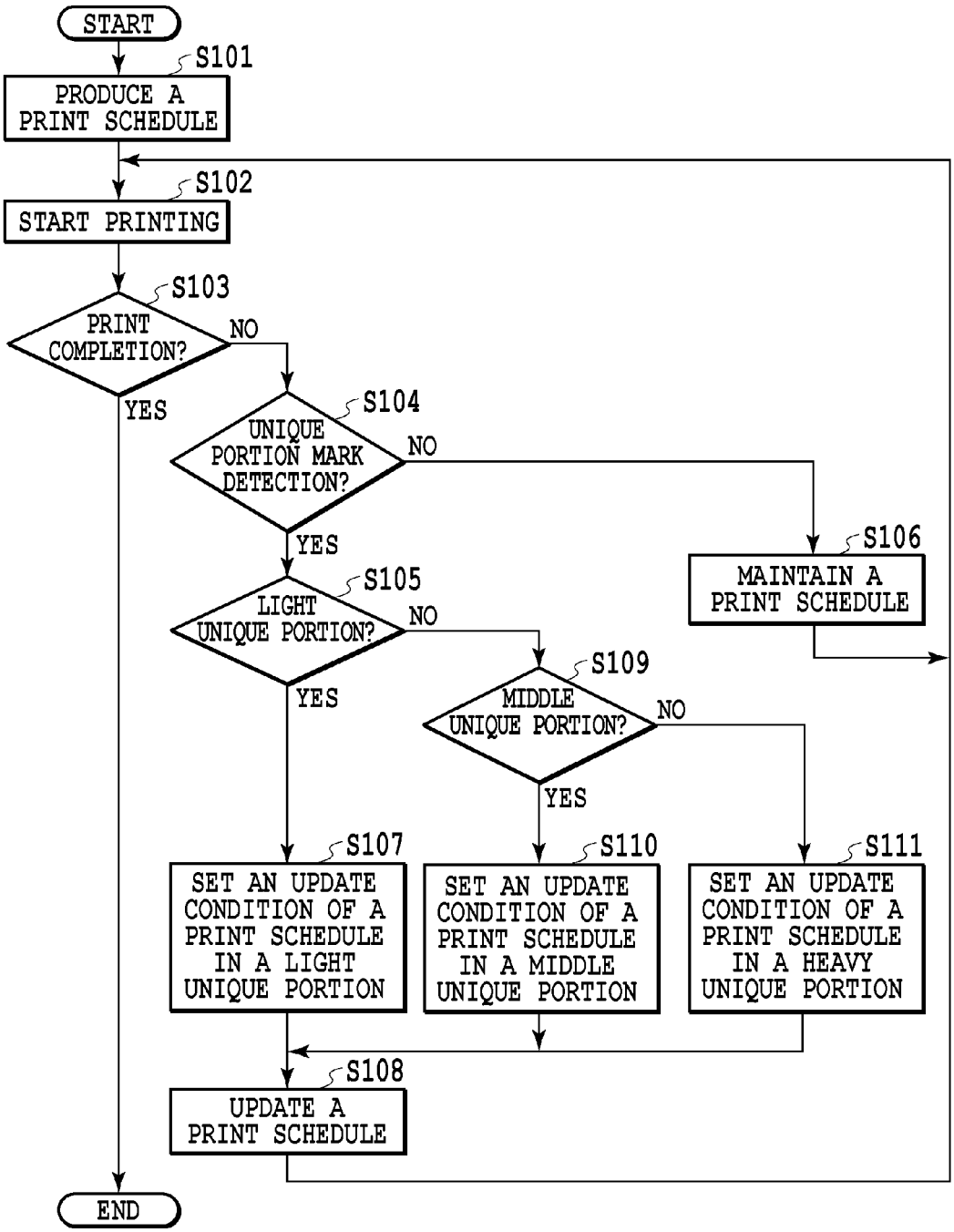
FIG. 4 is a flow chart showing a printing operation in the printing apparatus.

FIG. 4 is a flow chart showing the printing operation. As shown in this figure, when an instruction of the print start is provided by an operation of a user, the control unit 13 produces a print schedule based upon a print command (S101). The print schedule means data showing the order of printing a regular image that is printed on a sheet, a preliminary ejection pattern for print head maintenance (preliminary ejection), a detection pattern for print head maintenance (non-ejection detection), a cut patter, and the like. In the present embodiment, the print schedule is produced in the order of the image, the detection pattern, the preliminary ejection pattern, and the blank space region.

FIG. 4 will be again referred to. As shown in this figure, when the print schedule is produced (S101), the printing is started according to this print schedule (S102). After that, the control unit 13 determines whether or not the printing according to the print schedule is completed (S103). In a case where the printing is completed (in a case of YES at S103), a series of the processing ends. On the other hand, in a case where the printing is not completed (in a case of NO at S103), the control unit 13 determines whether or not the unique portion mark is detected during the printing by the sensor 17 (S104).

In a case where the unique portion mark is not detected (in a case of NO at S104), the control unit 13 maintains the print schedule (S106), the process goes back to S102 again, and the printing is started. In a case where the unique portion mark is detected (in a case of YES at S104), the control unit 13 determines the level of the unique portion (S105). In detail, the control unit 13 determines whether or not the unique portion is a light unique portion (S105).

In a case where the unique portion is the light unique portion (case of YES at S105), the control unit 13 sets an update condition of a print schedule of the light unique portion (S107). The print schedule of the light unique portion is set such that printing other than an image can be performed in the light unique portion.

In a case where the unique portion is not the light unique portion (case of NO at S105), the control unit 13 determines whether or not the unique portion is a middle unique portion (S109). In a case where the unique portion is the middle unique portion (case of YES at S109), the control unit 13 sets an update condition of a print schedule of the middle unique portion (S110). The print schedule of the middle unique portion is set such that only a disposal print can be performed in the middle unique portion.

In a case where the unique portion is not the middle unique portion (case of NO at S109), the control unit 13 determines that the unique portion is a heavy unique portion, and the control unit 13 sets an update condition of a print schedule of the heavy unique portion (S111). The print schedule of the heavy unique portion is set such that any printing can not be performed in the heavy unique portion.

After these update conditions (S107, S110, and S111) are set, the print schedule is updated according to the set update condition (S108). In the update processing of the print schedule, the print schedule is updated according to the level of detected unique portion. In addition, the process goes back to S102 and the printing is started according to updated print schedule. Thereafter, when the printing is completed (case of YES at S103), a series of the processing ends. When the printing is not completed (case of NO at S103), the above-mentioned processing is repeated.

In this way, at the time the printing is performed on the sheet 30 having the unique portion, the control unit 13 controls the printing according to the updated new print schedule.

FIGS. 5A to 5D are diagrams each showing a sheet on which printing is performed according to a print schedule. The print schedule before the updating is a schedule which an image, a detection pattern, and a preliminary ejection pattern are printed respectively between multiple cut patterns, and thereafter blank spaces exists.

Figures 5A, 5B, 5C, 5D:
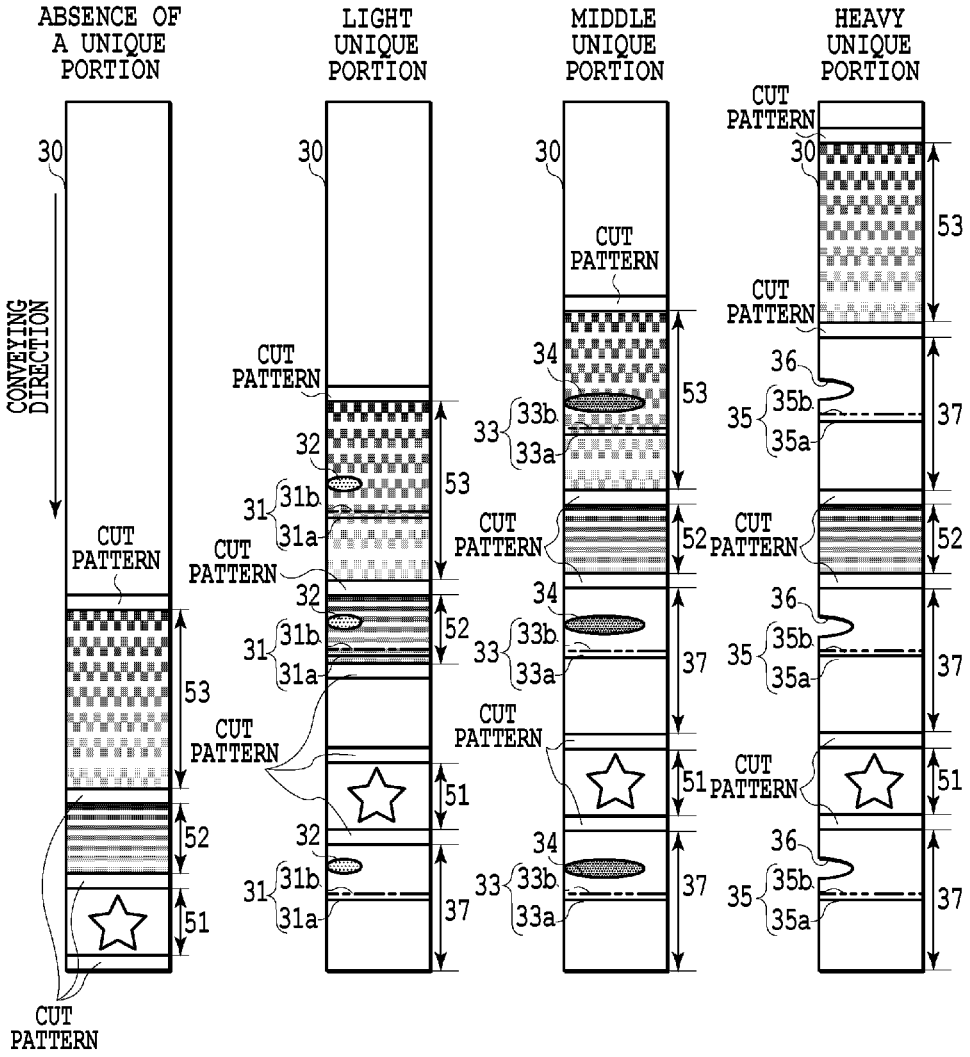
FIG. 5A is a diagram showing a state where printing is performed on a sheet having no unique portion in the printing apparatus.
FIG. 5B is a diagram showing a state where printing is performed on a sheet having light unique portions in the printing apparatus.
FIG. 5C is a diagram showing a state where printing is performed on a sheet having middle unique portions in the printing apparatus.
FIG. 5D is a diagram showing a state where printing is performed on a sheet having heavy unique portions in the printing apparatus.

FIG. 5A shows a sheet on which printing is performed according to the print schedule that is not updated because the sheet has no unique portion, and each of FIGS. 5B to 5D shows a sheet on which printing is performed according to the print schedule updated because the sheet has the unique portion. FIGS. 5B to 5D show examples in each of which unique portions that are equal in the level that the characteristic differs exist at three locations in the sheet 30.

FIG. 5A shows the sheet 30 on which printing is performed according to a print schedule in a case where a unique portion mark is not detected. As shown in FIG. 4 (case of YES at S103), since the printing can be performed as the print schedule in a case where the sheet has no unique portion, the print schedule is maintained without being updated. Therefore, as shown FIG. 5A, an image 51, a detection pattern 52, and a preliminary ejection pattern 53 respectively are sequentially printed to be sandwiched between cut patterns on the sheet 30. In addition, the preliminary ejection pattern 53 is printed and thereafter the cut pattern is printed. The area after the cut pattern becomes a blank space.

In a case where the unique portions exist in the sheet 30, the image 51 can not be printed in any unique portion. Therefore in a case where the unique portion exists in a position for printing the image 51, this region is defined as a non-printing area 37. Accordingly, as shown in FIGS. 5B to 5D, in a case where the unique portion exists in a position for printing the image 51 which is the head in the print schedule, the print image 51 is printed after the non-printing area 37 is conveyed.

FIG. 5B shows the sheet 30 on which the printing is performed according to the updated print schedule in a case where a light unique portion mark 31 is detected (case of YES at S105 shown in FIG. 4). As described above, the light unique portion 32 is a region where printing other than the image can be performed. Therefore the print schedule is updated such that the image 51 is not printed in the light unique portion 32. As a result, as shown in FIG. 5B, the detection pattern 52, and the preliminary ejection pattern 53 are printed in the light unique portion 32.

As shown in FIG. 5B, after the non-printing area 37 is conveyed, the printing is performed on the sheet 30 according to the schedule of the cut pattern, the image 51, the cut pattern, the blank space, the cut pattern, the detection pattern 52, the cut pattern, the preliminary ejection pattern 53, the cut pattern, and the blank space.

Even if a pattern, such as a detection pattern, with the aim of being read by a sensor and analyzed is printed in a region where the light unique portion 32 exists, since the density of the light unique portion 32 is relatively light, the light unique portion 32 is not so much impeditive at the time of reading the pattern. Therefore in the present embodiment, the pattern other than the image is printed in the light unique portion 32.

FIG. 5C shows the sheet 30 on which the printing is performed according to the updated print schedule in a case where a middle unique portion mark 33 is detected (case of YES at S109 shown in FIG. 4). As described above, the middle unique portion 34 is a region where only the disposal printing can be performed. Therefore the print schedule is updated such that the image 51 and the detection pattern 52 are not printed in the middle unique portion 34. As a result, as shown in FIG. 5C, only the preliminary ejection pattern 53 is printed in the middle unique portion 34.

As shown in FIG. 5C, after the non-printing area 37 is conveyed, the printing is performed on the sheet 30 in the schedule of the cut pattern, the image 51, and the cut pattern. In addition, after the non-printing area 37 is conveyed, the printing is performed on the sheet 30 in the schedule of the cut pattern, the detection pattern 52, the cut pattern, the preliminary ejection pattern 53, the cut pattern, and the blank space.

As described above, the middle unique portion 34 is a region deeper in the density than the light unique portion 32. Therefore even if a pattern with aim of being read is printed in the middle unique portion 34, there is a fear that the pattern can not be appropriately read in or analyzed. Therefore the middle unique portion 34 is not suitable for an image printed matter, but also is not suitable for printing the reading printed matter. However, since the middle unique portion 34 has no hole or break, the middle unique portion 34 can absorb ink. Accordingly, only the disposal printing that is not read in by the sensor is printed in the middle unique portion 34.

FIG. 5D shows the sheet 30 on which the printing is performed according to the updated print schedule in a case where a heavy unique portion mark 35 is detected (case of NO at S109 shown in FIG. 4). As described above, the heavy unique portion 36 is a region not appropriate to all printing. Therefore the print schedule is updated such that any printing is not performed in the heavy unique portion 36. As a result, as shown in FIG. 5D, not only the printing for the image printed matter but also the printing for the auxiliary printed matter are not performed in the non-printing area 37 including the heavy unique portion mark 35 and the heavy unique portion 36.

As shown in FIG. 5D, after the non-printing area 37 is conveyed, the printing is performed on the sheet 30 in the schedule of the cut pattern, the image 51, and the cut pattern. In addition, after the non-printing area 37 is conveyed, the printing is performed on the sheet 30 in the schedule of the cut pattern, the detection pattern 52, and the cut pattern. In addition, after the non-printing area 37 is conveyed, the printing is performed on the sheet 30 in the schedule of the cut pattern, the preliminary ejection pattern 53, the cut pattern, and the blank space.

In this way, in the present embodiment, an application of the unique portion is determined according to the level that the characteristic of the unique portion in the sheet differs. That is, also in a case where the unique portion exists in the sheet, if the unique portion can be used in any application according to the level of the characteristic, the print schedule is updated as use the unique portion. As a result, even if the unique portion exists in the sheet, the sheet can effectively be used by using the unique portion according to an optimal use method in accordance with the state of the unique portion. Therefore in the present embodiment, the wasteful disposal of the sheet can be suppressed, the consumption amount of the sheet as a whole can be suppressed.

It should be noted that in the present embodiment, the explanation was made about the method of reading the detection pattern and the cut pattern by the scanner of the inspection unit 5 and by the cut pattern sensor 22 of the cutter unit 6 that are provided in the printing apparatus 20. However, in the present invention, the method of reading in the pattern is not limited to method of using the scanner and the like that are provided in the printing apparatus 20, for example, the pattern may be confirmed by the reading-in by an external device or by a visual contact of an operator.

As a result of reading in the detection pattern by the external device or the visual contact of the operator, in a case where it is determined that the detection pattern is not appropriately printed, the determination result is notified to the operation unit 15 or the host device 16 to control the printing apparatus 20 to once more print the pattern as needed. If the external device is equipped with a communication function, the printing apparatus 20 may be controlled by using a communication unit which has the communication function which connects the external device to the printing apparatus 20. The operator may operate the operation unit 15 or the host device 16. Further, a printing system including the host device 16 and the printing apparatus 20 is also encompassed within the scope of the present invention.

In the present embodiment, even if the unique portion exists in a position of printing the cut pattern, the cut pattern is printed in that position only in a case where the unique portion is the light unique portion. Therefore, there does not occur a state of being not able to read the cut pattern. As a result, the image can also be completed by cutting the sheet according to the cut pattern by the external device or the operator.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-169226, filed Jul. 31, 2012, which is hereby incorporated by reference herein in its entirety.

What is claimed is:

1. A control method for printing a plurality of images on a continuous sheet by using a print head, the control method comprising the steps of:

determining a level of influence on printing that a unique portion on the continuous sheet provides; and printing the plurality of images, which include a page image and a maintenance image, on the continuous sheet, wherein, in a case where the unique portion exists in a position for printing the image and the level is determined as a first level, printing of the page image on the unique portion is restricted while printing of the maintenance image thereon is permitted, and wherein, in a case where the unique portion exists in a position for printing the image and the level is determined as a second level higher than the first level, printing of the page image on the unique portion and printing of the maintenance image on the unique portion are both restricted.

2. A control method according to claim 1, wherein the unique portion includes at least one of dirt, a hole, a damage, a fold, a break, foreign object mixing, a change in color, a portion uneven in thickness, and a connecting portion of the sheet which exist on the sheet.

3. A control method according to claim 1, further comprising the step of:

producing a print schedule, wherein the print schedule is maintained in a case where the unique portion is not detected, and wherein the print schedule is changed in a case where the unique portion is detected.

4. A control method according to claim 1, wherein the maintenance image includes a first maintenance image to be read and a second maintenance image not to be read, wherein printing of the second maintenance image on the unique portion is permitted while printing of the first maintenance image thereon is restricted in a case where the unique portion exists in a position for printing the image and the level is determined as the first level, and wherein printing of the first maintenance image on the unique portion and printing of the second maintenance image on the unique portion are both permitted in a case where the unique portion exists in a position for printing the image and the level of the unique portion is determined as a third level lower than the first level.

5. A control method according to claim 4, wherein the first maintenance image includes a non-ejection detection pattern, and wherein the second maintenance image includes a preliminary ejection pattern.

6. A printing apparatus for printing a plurality of images on a continuous sheet by using a print head, the printing apparatus comprising:

a determining unit configured to determine a level of influence on printing that a unique portion on the continuous sheet provides; and a print control unit configured to cause the print head to print the plurality of images, which include a page image and a maintenance image, on the continuous sheet, wherein the print control unit (1) in a case where the unique portion exists in a position for printing the image and the level is determined by the determining unit as a first level, restricts printing of the page image on the unique portion while permitting printing of the maintenance image thereon, and (2) in a case where the unique portion exists in a position for printing the image and level is determined by the determining unit as a second level higher than the first level, restricts both printing of the page image on the unique portion and printing of the maintenance image on the unique portion.

7. A printing apparatus according to claim 6, wherein the unsuitable unique portion includes at least one of dirt, a hole, damage, a fold, a break, foreign object mixing, a change in color, a portion uneven in thickness, and a connecting portion of the sheet which exist on the sheet.

8. A printing apparatus according to claim 6, wherein the maintenance image includes a first maintenance image to be read and a second maintenance image not to be read, wherein printing of the second maintenance image on the unique portion is permitted while printing of the first maintenance image is restricted in a case where the unique portion exists in a position for printing the image and the level of the unique portion is determined as a first level, and wherein printing of the first maintenance image on the unique portion and printing of the second maintenance image on the unique portion are both permitted in a case where the unique portion exists in a position for printing the image and the level of the unique portion is determined as a third level lower than the first level.

9. A printing apparatus according to claim 8, wherein the first maintenance image includes a non-ejection detection pattern, and wherein the second maintenance image includes a preliminary ejection pattern.

10. A printing apparatus according to claim 6, wherein the print schedule is maintained in a case where the unique portion is not detected, and wherein the print schedule is changed in a case where the unique portion is detected.

* * * * *